US006807759B1

(12) United States Patent
Burder

(10) Patent No.: US 6,807,759 B1
(45) Date of Patent: Oct. 26, 2004

(54) METHOD FOR VIEWING A FULL COLOR ANIMATION

(76) Inventor: David G. Burder, 31, The Chine, Grange Park, London, N21 2 EA (GB)

( * ) Notice: Subject to any disclaimer, the term of this patent is extended or adjusted under 35 U.S.C. 154(b) by 0 days.

(21) Appl. No.: 10/248,238

(22) Filed: Dec. 30, 2002

(51) Int. Cl.[7] ..... G09F 19/14
(52) U.S. Cl. ..... 40/453; 345/629; 359/885
(58) Field of Search ..... 40/453, 454, 427; 359/619, 885; 283/94, 98, 114; 382/163, 167; 345/473, 600, 629, 634, 949

(56) References Cited

U.S. PATENT DOCUMENTS 3,281,960 A * 11/1966 Gross ..... 434/331
4,189,353 A * 2/1980 Harriman ..... 283/67
4,869,946 A * 9/1989 Clay ..... 428/167
5,695,346 A * 12/1997 Sekiguchi et al. ..... 434/365
5,720,123 A * 2/1998 Taylor ..... 40/454
6,016,225 A * 1/2000 Anderson ..... 359/619
6,070,350 A * 6/2000 Fantone et al. ..... 40/454
6,175,371 B1 * 1/2001 Schoulz et al. ..... 345/630
6,405,464 B1 * 6/2002 Gulick et al. ..... 40/454
2004/0071348 A1 * 4/2004 Harrington et al. ..... 382/232

* cited by examiner

*Primary Examiner*—Andrew Wright
(74) *Attorney, Agent, or Firm*—Ronald E. Smith; Smith & Hopen, P.A.

(57) ABSTRACT

A full color image containing two stages of animation where each stage is printed in complementary color components. A preselected part of the image includes no stages of animation so that the preselected part remains in perfect registration and coincidence with itself when the two stages of animation are viewed. A viewing device contains a single sheet of filter material having at least two complementary colors disposed in abutting relation to one another. The viewing device is reciprocated up and down or from left to right depending upon the embodiment to change the colors perceived by the user's eyes.

2 Claims, 1 Drawing Sheet

METHOD FOR VIEWING A FULL COLOR ANIMATION

BACKGROUND OF INVENTION

1. Field of the Invention

This invention relates, generally, to printed images that animate when viewed through integral filters.

2. Description of the Prior Art

Colored filters are well known for their ability to enhance certain colors in an image. They are also well known for their ability to selectively conceal or reveal an image according to whether that image is printed in similar or complementary colors, and according to the colors of the background. If two line-work images are printed in complementary colors, such as red and green, then it is possible to look through a red filter and then through the green filter, so as to first reveal one image followed by another.

However, the known changing image systems have a few drawbacks such as: 1) the images are not in full color; 2) the cost of two separate pieces of filter material for each eye of the viewing device-is double the cost of one filter; 3) having to insert two filters into each eye of a viewing device increases the cost; and 4) it is awkward to fit two separate filters into a viewer without having a join line that disturbs the effectiveness of the changing image.

Accordingly, there is a need for a viewing system that enables animation and viewing of full color images. The needed system would use a viewer that employs only a single piece of filter material that can be mounted into the viewing device. In this way, only a single piece of filter material would be positioned in both eyes of the viewing device, thereby eliminating join lines.

There is also a need for a viewing device that enables animation of full color images that can be used with one eye or both eyes, to equal effect.

Most filters for viewing devices are manufactured by mixing colorants into the plastic before it is extruded into thin film, which is then suitable for automatic insertion onto viewing spectacles. However, such bulk mixing method rules out manufacture of film containing stripes of different colors.

There is also a need, therefore, for a method that enables the manufacturing of film having stripes of differing colors that is not subject to the limitations of the prior art.

However, in view of the prior art considered as a whole at the time the present invention was made, it was not obvious to those of ordinary skill in this art how the needed viewing device and method could be provided.

SUMMARY OF INVENTION

The long-standing but heretofore unfulfilled need for a low cost, printable in full color animation system, utilizing a single filter material is now met by a new, useful, and nonobvious invention.

The invention includes a full color image containing two stages of animation, wherein each stage is converted to its complementary color components before being re-converted to cyan, magenta, yellow, and black channels for conventional cyan, magenta, yellow and black color printing.

In the full color printed image containing two stages of animation, at least one part of a first image is In perfect register and coincidence with a corresponding part of a second image.

The novel viewing device contains a single sheet of filter material having two or more complementary colors in abutting relation to one another. The novel viewing device is adapted to be rapidly raised and lowered, or moved from side to side, to change colors observed by a user's eyes.

The novel viewing device provides animation effects and contains at least two strips of two repeating colors.

The novel method provides a full color image containing two stages of animation, wherein each stage is printed In complementary color components.

More particularly, the full color image contains two stages of animation, wherein at least one part of a first image is in perfect register and coincidence with a corresponding part of a second image.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
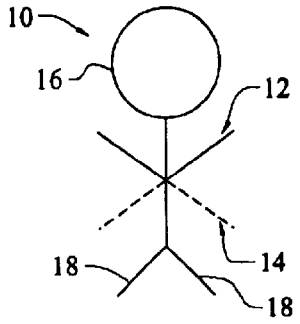
FIG. 1 is a front elevational view of a stick figure.

Referring to the front elevational view of FIG. 1, it will there be seen that the reference numeral 10 denotes an animation having two images that differ from one another. The animation will be referred to hereinafter as a full color graphic image and the two images that differ from one another will be referred to as the first and second images.

As depicted in FIG. 1, a full color graphic image in the form of a stick FIG. 10 having two arms is depicted with said and in a first position denoted in solid lines by the reference numeral 12 and in a second position denoted in dotted lines by the reference numeral 14. Head 16 and legs 18 have one fixed position in this example. An unnumbered vertical line forms a torso that interconnects head 16 and legs 18. Head 16, leas 18, and the unnumbered torso collectively form a base of the full color graphic image. When the full color graphic image is viewed in the manner disclosed hereinafter, its arms 12, 14 will appear to flap up and down between the first and second positions but the base will be stationary. In other words the first image (are 12 in the first position) and tilt; second image (arms 14 in the second position) will appear to move with respect to the fixed position base.

Arms 12 are printed in a first preselected color and arms 14 are printed in a second preselected color, that is complementary to the first color. Head 16, legs 18 and the unnumbered torso are in both colors or a color seen equally by both 12 and 14.

One such combination of colors is the combination of red+green+blue (RGB) colors. This is the preferred, but not exclusive, combination of colors.

Next, each phase of animation must be separated into these red, blue, and green components. Then, to combine the two animation images, the red component of either image is added to the green and blue components of the other image. More particularly, in this two image RGB example, the red component of the first image is added to thee green and blue components of the second image and the red component of the second image is added to the green and blue components of the first image.

This produces a new image in full color because it contains all three color components of RGB. Wherever the two images are in perfect register, the newly formed combination image appears exactly the same color as the original images. However, any changes In position will appear as either a red or a cyan (green and blue) image.

When viewed through a red or cyan (green and blue) filter, a first phase or a second phase of the two phases of animation can be seen.

To make it possible to print the RGB image, using regular inks and regular printing processes, it is necessary to use standard image processing software such as Adobe® Photoshop® software to convert the image into regular cyan, magenta, yellow, and black components.

Figure 2:
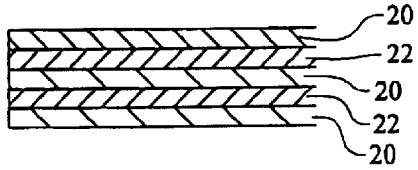
FIG. 2 is a sectional view of an uncut sheet of filter material.

FIG. 2 depicts an uncut sheet of filter material including alternating stripes of complementary colors 20 and 22. As depicted in FIG. 2, the filter material has not yet been cut into pairs of striped material.

Figure 3:
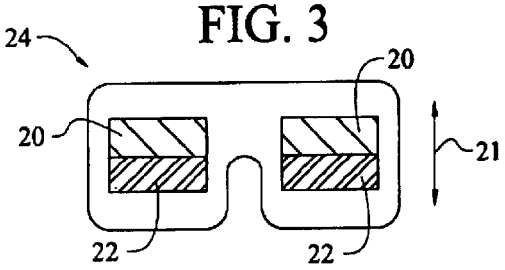
FIG. 3 is a front elevational view of a pair of reading glasses depicting the filters in a first position.

FIG. 3 depicts a pair of viewing glasses 24 where the respective top halves of each filter are a common color 20 and the respective bottom halves are of a different and complementary color 22.

Binocular viewers are preferred for comfort of viewing but single eye viewers are less expensive. Whether the viewer Is monocular or binocular, It Is raised and lowered to create the animation as indicated by double-headed directional arrow 21.

Figure 4:
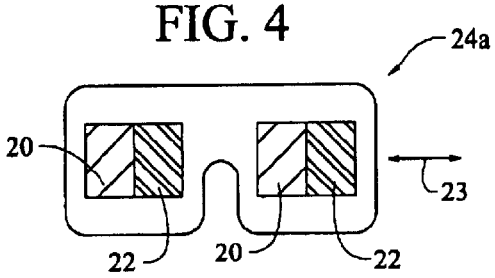
FIG. 4 is a is a front elevational view of a pair of reading glasses depicting the filters in a second position that is rotated ninety degrees from the first position.

FIG. 4 depicts viewing glasses 24*a* having filters rotated ninety degrees (90°) relative to their respective FIG. 3 positions for push/pull (left-to-right reciprocation) animation as Indicated by double-headed directional arrow 23.

Figure 5:
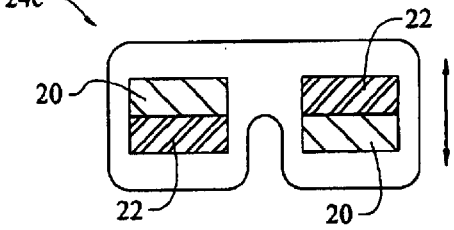
FIG. 5 is a front elevational view of a pair of reading glasses depicting one of the filters in an inverted position.

FIG. 5 depicts a three dimensional, stereoscopic viewing glasses 24*c* where one eye thereof has the filter material inverted relative to the FIG. 3 position thereof.

Figure 6:
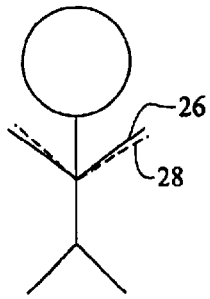
FIG. 6 is a front elevational view of a stereoscopic pair of images.

FIG. 6 depicts a stereoscopic pair of images, in which one image 26 is rotated relative to a second image 28, with part of the Image remaining in register.

Figure 7:
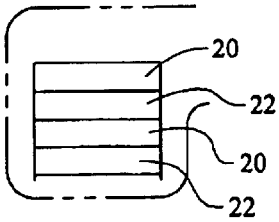
FIG. 7 is a front elevational view of a filter having more than two stripes of the color in the viewer.

FIG. 7 depicts the use of at least three stripes of the colors in the viewer.

Figure 8:
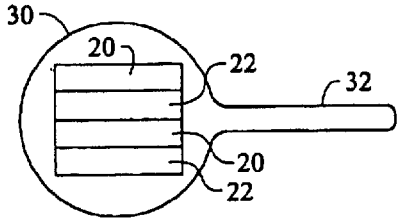
FIG. 8 is a front elevational view of a one-eyed viewer.

FIG. 8 depicts a one-eyed viewer having frame 30 and handle 32.

The novel method is performed by coating a single sheet of filter material with two or more stripes of completely separate and different complementary filter colors, such as red and green, magenta and cyan, red and cyan, red and blue, or yellow and purple, for example. The colored stripes may be created by one or more methods including wiping a clear plate substrate (film) with "fingers" of the appropriate color, or by printing with transparent ink, or by laminating strips of colors.

Because the two filter colors are made as a single item, they perfectly abut one another. Therefore, only a small amount of movement is required to achieve immediate change from one image to the other. This immediacy Is essential to give the effect of animation between two suitable encoded images.

The coating of three or more thin stripes onto a filter, such as red-cyan-red-cyan, provides much improved animation as the user needs only to move the viewer in one direction, as distinguished from reciprocating the viewer continuously up and down.

Full color animation is achieved by using full color images and suitable filters.

The use of complementary color components for each stage of animation allows each stage of animation to be seen separately.

The two images must be coincident with one another over at least some part thereof. Unless some part of the image is coincident, the animation appears disjointed and the resulting animation appears as two different images, rather than as a single image that moves.

To make the image appear to move, the top and bottom filters need to be in immediate proximity to one another, i.e. , a first color should abut a second color.

In theory, it is possible to have two pieces of filter material positioned one above the other, but such procedure is costly and impractical for large production runs. Also, any spacing or gap between them destroys the Illusion of continuous action.

Where five million, or some other large number, viewing devices are to be manufactured for use in a large promotion, such as used in cereal packets, the filter material should be manufactured as a one piece filter to minimize the cost and time required to make one viewer.

As mentioned in the discussion of the prior art, most filters for viewing devices are manufactured by mixing colorants Into the plastic before it is extruded into thin film, which is then suitable for automatic insertion onto viewing spectacles. However, such bulk mixing method rules out manufacture of film containing stripes of different colors. Attempts to print transparent inks onto clear film are only partly effective because the ink tends to disturb the clarity of the image being viewed.

The preferred and fully achieved technique is in continuous wiping of the appropriate dyes. This results in adjacent stripes of color, each with absorption characteristics, on continuous rolls, which can be automatically fed into viewer production.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A method for viewing a full color graphic image, comprising the steps of:

printing a fill color graphic image having a fixed position base in full color;

printing a first image in a first color, said first image not forming a part of said base;

printing a second image in a second color that is complementary to the fast color, said second image not forming a part of said base;

converting the first color of the first image into a color that is complementary to the first color;

converting the second color of the second image into a color that is complementary to the second color;

separating the complementary color of the first image into its components;

separating the complementary color of the second image into its components;

adding a first preselected component of the first image to second and third components of the second image;

adding a fist preselected component of the second image to second and third components of the first image;

providing a viewer having a first filter of a first preselected color that enables a viewer to see said first image but not said second image;

said viewer having a second filter of a second preselected color that is completely separate from and complementary to said first color of said first filter, said second filter enabling said viewer to see said second image but not said first image;

positioning said viewer between a viewer's eyes and said full color graphic image; and moving said viewer back and forth;

whereby the first and second images are alternately seen through said first and second filters of complementary colors, creating an appearance of motion of said first and second images relative to said fixed position base; and whereby the full color graphic image, including said base and said first and second images, appears in fill color to an unaided eye.

2. The method of claim 1, further comprising the steps of:

positioning at least one pant of said first image in perfect registration and coincidence with a corresponding part of said second image.

* * * * *